US005171371A

United States Patent [19]

Desai

[11] Patent Number: 5,171,371

[45] Date of Patent: Dec. 15, 1992

[54] METHOD TO TREAT POROUS STONES FOR USE IN DISTRESSING FABRIC USING HIGH PRESSURE STEAM AND STONES TREATED ACCORDING TO THE METHOD

[75] Inventor: Girish R. Desai, El Paso, Tex.

[73] Assignee: Greater Texas Finishing Corporation, El Paso, Tex.

[21] Appl. No.: 553,900

[22] Filed: Jul. 16, 1990

[51] Int. Cl.[5] ..... B08B 3/00

[52] U.S. Cl. ..... 134/30; 134/34; 134/37

[58] Field of Search ..... 8/101, 111; 264/109, 264/122, 83, 82; 51/293; 134/34, 37, 30

[56] References Cited

U.S. PATENT DOCUMENTS

| | | | |
|---|---|---|---|
| 3,752,762 | 8/1973 | Cincotta | 210/671 |
| 4,575,887 | 3/1986 | Viramontes | 8/158 |
| 4,740,213 | 4/1988 | Ricci | 8/108 |
| 4,816,033 | 3/1989 | Hoffer et al. | 8/158 |
| 4,850,156 | 7/1989 | Bellaire | 51/293 |
| 4,919,842 | 4/1990 | Dickson et al. | 252/186 |

*Primary Examiner*—Prince Willis, Jr.
*Assistant Examiner*—John F. McNally
*Attorney, Agent, or Firm*—Hale and Dorr

[57] ABSTRACT

This invention is directed to a method for improving the quality of pumice stones that are used to finish fabrics or garments with a distressed look. In this invention, the pumice stones are first injected with steam at a pressure above atmospheric pressure to remove dust and other particles, and to drive the air out of the pumice stone pores. The steam cleaned stones are impregnated with an oxidizing agent. The high pressure steam pretreatment enables the pumice stones to absorb the oxidizing agent solutions quickly and throughout the entire stone, resulting in an even and thorough penetration of the oxidizing agent solution in the pumice stones, which can then be used to distress fabrics and garments.

7 Claims, 2 Drawing Sheets

METHOD TO TREAT POROUS STONES FOR USE IN DISTRESSING FABRIC USING HIGH PRESSURE STEAM AND STONES TREATED ACCORDING TO THE METHOD

This invention relates generally to the distressing of fabrics using porous abrasive stones impregnated with a reactive oxidizing solution. In particular, the invention relates to a method of impregnating porous abrasive stones with reactive agents using high pressure steam, and to the stones so treated.

Relatively stiff, uniform color fabrics, such as cotton denim, are popularly used in modern fabrics. Some customers prefer denim apparel which has been pretreated before purchase, to soften the material and to simulate long periods of use and aging. These fabrics are referred to generally as distressed, pre-washed, preworn, etc. A typical process in the industry is to "stone wash" the garments using abrasive stones in a tumbling apparatus to wear down the fabric or garment in a random pattern. It is also known to use porous stones having a high absorption characteristic and to impregnate the stones with a reactive or oxidizing solution, such as a bleach, to further soften and distress the garment.

When used in conjunction with the reactive solution, the porous stones absorb the reactive solution into their internal passages and gradually release the reactive solution as the stone washing process continues. The oxidizing agents used include potassium permanganate, sodium hypochlorite, sodium chlorite, sodium persulfate, sodium percarbonate and hydrogen peroxide.

The stones used are typically pumice stones, a relatively soft stone derived from volcanic activity. Pumice stone is typically porous and a good vehicle for the absorbed reactive oxidizing agent. Pumice stones come from various sources around the world including Arizona, New Mexico, California, Mexico, Greece and Turkey. The chemical content of the pumice stone varies depending upon its source. Typically varying chemicals include silicone dioxide, aluminum oxide, titanium dioxide, manganese oxide, calcium oxide, ferric oxide, potassium oxide, sulfuric oxide and sodium oxide. Due to the varying chemical composition, physical properties of the pumice stones such as porosity, absorbency, size shape, loss on ignition and moisture content also vary depending upon the source and composition.

It is usually necessary to drain excess fluid from the stones before the fabric is treated. If not, then, initially, the liquid would quickly flow from the porous stones onto the fabric in an irregular and uncontrolled fashion, causing large patches of distressed, or whitened fabric. This is often undesireable.

In the course of treating apparel to be distressed, the fabric or made up garment is placed in a tumbler, such as a heavy industrial washing machine, along with a quantity of the stones.

Typically, the stones have previously been soaked or impregnated with the reactive agent. U.S. Pat. No. 4,850,156, entitled, "Method of Impregnating Porous Abrasive Elements for Use in Distressing Fabrics," issued Jul. 25, 1989 to David L. Bellaire, discloses a method to impregnate the stones with the reactive agent and is hereby incorporated by reference. The stones are first brought to a pressure below ambient and then the reactive solution is fed into the stones from a higher pressure. Theoretically, the reduction in pressure evacuates air and other obstructions from the passages in the porous stones, thereby facilitating filling those porous passages with the reactive material.

As will be understood, the degree to which the fabric becomes distressed varies from fabric to fabric and depends typically on the dye, fabric, abrasive characteristics of the stone and the capacity for the stone to absorb and then subsequently dispense the reactive material.

A fabric that is relatively more distressed is one for which the effect of the oxidizing agent, which is a general whitening of the fabric, is more widespread and more uniform. Fabric that is relatively less distressed has a less regular distribution of whitened fabric and thus, has larger patches of whitened fabric.

A drawback of known method is that the porous pumice stones have air and foreign particles, such as pumice dust, filling up their internal channels and cavities. When simply soaked in the reactive solution, the air, dust particles and other particles impede the impregnation of the stones with the reactive solution. Consequently, the reactive solution occupies only the outer portions of the channels. Bubbles of air remain inside.

Because the pumice stones are only partially impregnated, after a certain period of time the full quantity of the reactive solution drawn up into the pumice stones is released into the fabric being treated or into the mixer containing the fabric. Further, as the stones tumble in the tumbler with the fabric, their outer layers are abraded and eroded away so that the portion that had been holding the reactive solution is gone. These stones are thus depleted of their entire charge of reactive solution sooner than they would be if the innermost portions of the channels were also filled with the reactive solution. Thus, larger amounts of pumice stones must be used for the same amount of fabric material, which entails additional costs, not only in material but in the handling of the pumice stone, and in the amount of fabric that can be treated in each load of a standard size tumbling machine. Significant time savings are also achieved because it is not necessary to unload the stones after each distressing run and recharge the mixer with newly treated stones.

OBJECTS OF THE INVENTION

Thus, the several objects of the invention are to increase the solution holding capacity of the pumice stones without requiring expensive or complicated methods such as a constant application of vacuum; to increase the useful life of a quantity of pumice stone impregnated with a reactive solution, minimize the amount of handling of the impregnated stones; to increase the volume of production; and to provide consistent quality in finishing.

SUMMARY OF THE INVENTION

The invention includes a method for impregnating porous stones, such as pumice stones, including the steps of placing the stones in a pressurizable container, injecting steam into the container at a pressure above atmospheric pressure, exposing the stone filled container to atmospheric pressure, introducing a solution of oxidizing agent to the pumice stones to completely contact all surfaces of the stones; removing the stones from the solution and removing excess oxidizing agent solution from the stones. The resultant porous stone is impregnated substantially throughout its entire body.

DETAILED DESCRIPTION OF PREFERRED EMBODIMENTS OF THE INVENTION

Figure 1:
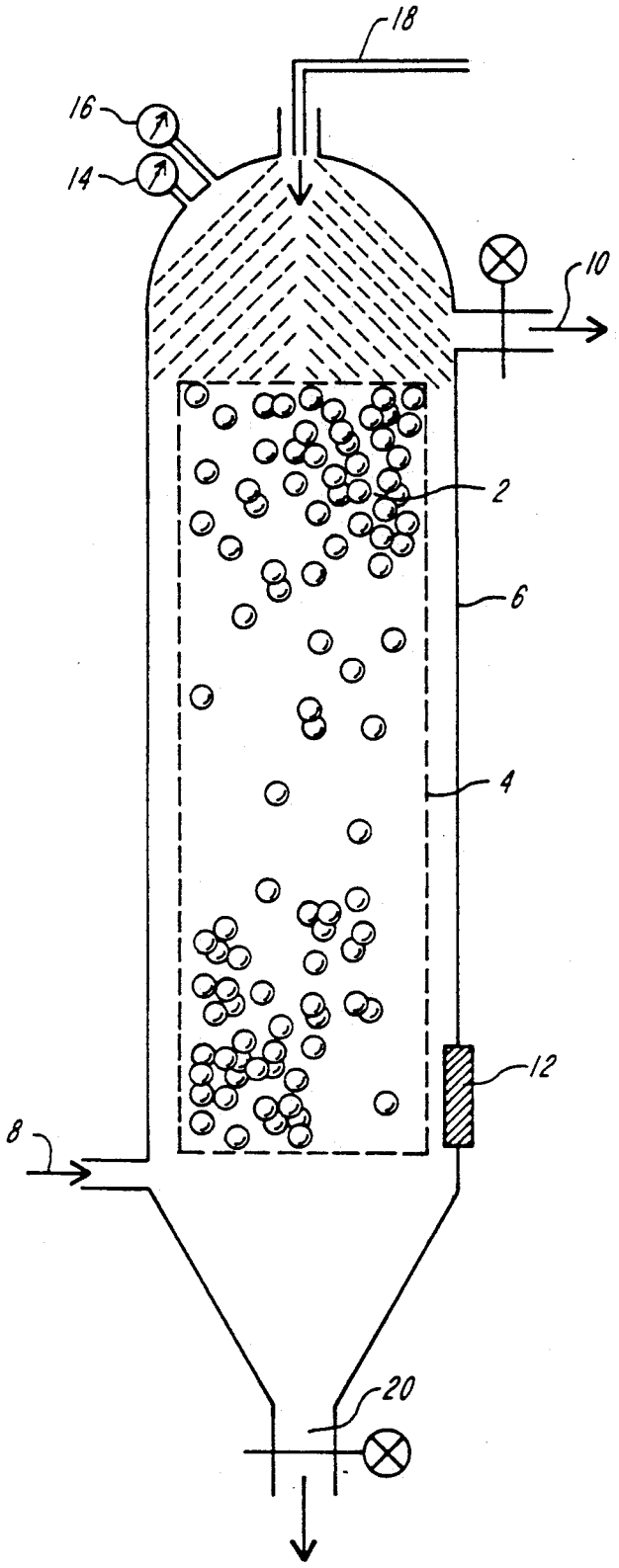
FIG. 1 shows a schematic cross-sectional view of an apparatus used in a first embodiment of the method of the invention for exposing the pumice stones to pressurized steam and oxidizing agent.

Turning now to FIG. 1, the method of the invention will be discussed in detail. A quantity of porous stones such as pumice stones 2 are secured in an open walled vessel 4. By "open walled" it is meant a structure having suitably rigid container walls to retain the pumice stone. The walls contain openings of a size sufficiently small to prevent the pumice stone from escaping. However, the openings must be sufficiently large to admit the introduction of pressurized steam and also the oxidizing agent solution at a reasonable flow rate. Suitable open wall containers may be made from screen, mesh, stamped sheet metal; formed wire cages, etc. It is also possible to maintain groups of the pumice stones within the open wall vessel within individual plastic net bags, such as the type used to sell produce such as onions and potatoes in grocery stores. Thus, there would be several bags maintained in the cage at one time, each bag containing a large number of individual stones.

The open wall vessel 4 is maintained in a pressurizable vessel 6. The vessel is a conventional pressurizable vessel having an inlet port 8 for introduction of steam, an outlet port 10 for the removal of steam and a door assembly 12 for the removal of pumice stones 2 after they have been treated. Gauges 14 and 16 are also provided for recording the temperature and the pressure respectively inside the pressurizable vessel. An inlet port 18 is provided for introducing oxidizing agent into the pressure vessel after the pressure has been removed. A valve 20 is provided at the bottom of the pressure vessel for removing the excess oxidizing agent from the pressure vessel as the stones are drained.

In operation, the stones 2 are placed into the open wall vessel 4, which is then placed into the pressure vessel 6. The steam is applied through inlet port 8 until the pressure vessel reaches approximately 20 psi and the pumice stones are steamed for approximately five minutes. The steam under high pressure impregnates substantially all of the pores and passageways in the pumice stones. Although it is not entirely understood, it is believed that when the pressure is reduced back to atmospheric, the pores within the pumice stones remain partly impregnated with steam and condensed water. Excess steam is released through vent 10. After the steam has been released and the pressure has been returned to atmospheric, a solution of oxidizing agent, selected from the group identified above, is applied through port 18. At this time, the valve 20 is kept closed. The entire vessel fills up with oxidizing agent solution.

Due to the presence of the liquid water vapor and condensed water in the pores and hollows of the pumice stones, it is believed that capillary action draws the oxidizing solution entirely into all of the internal spaces and passageways of the pumice stones. This is in contrast to the situation when the pumice stones are filled with air and particles blocking the passageways, as is the case with many methods of the prior art. In the prior art, the pumice stones are not fully impregnated with the liquid and remain only 40 to 60% filled. It has been determined with the present invention that the capillary action draws the liquid oxidizing agent into the pumice stones to a substantially complete extent. It will be understood that different concentrations of the oxidizing agent may be used, depending on the desired degree of distress, and the specific stones and fabric used. A typical concentration of the oxidizing agent is 4% by weight of 99.3% pure granulated potassium permanganate ($KMnO_4$) dissolved in 96% by weight water.

It will be understood that use of the open walled container 104 is not absolutely necessary, but it does facilitate handling the stones, both loading and unloading from the pressure vessel 6.

Figure 2:
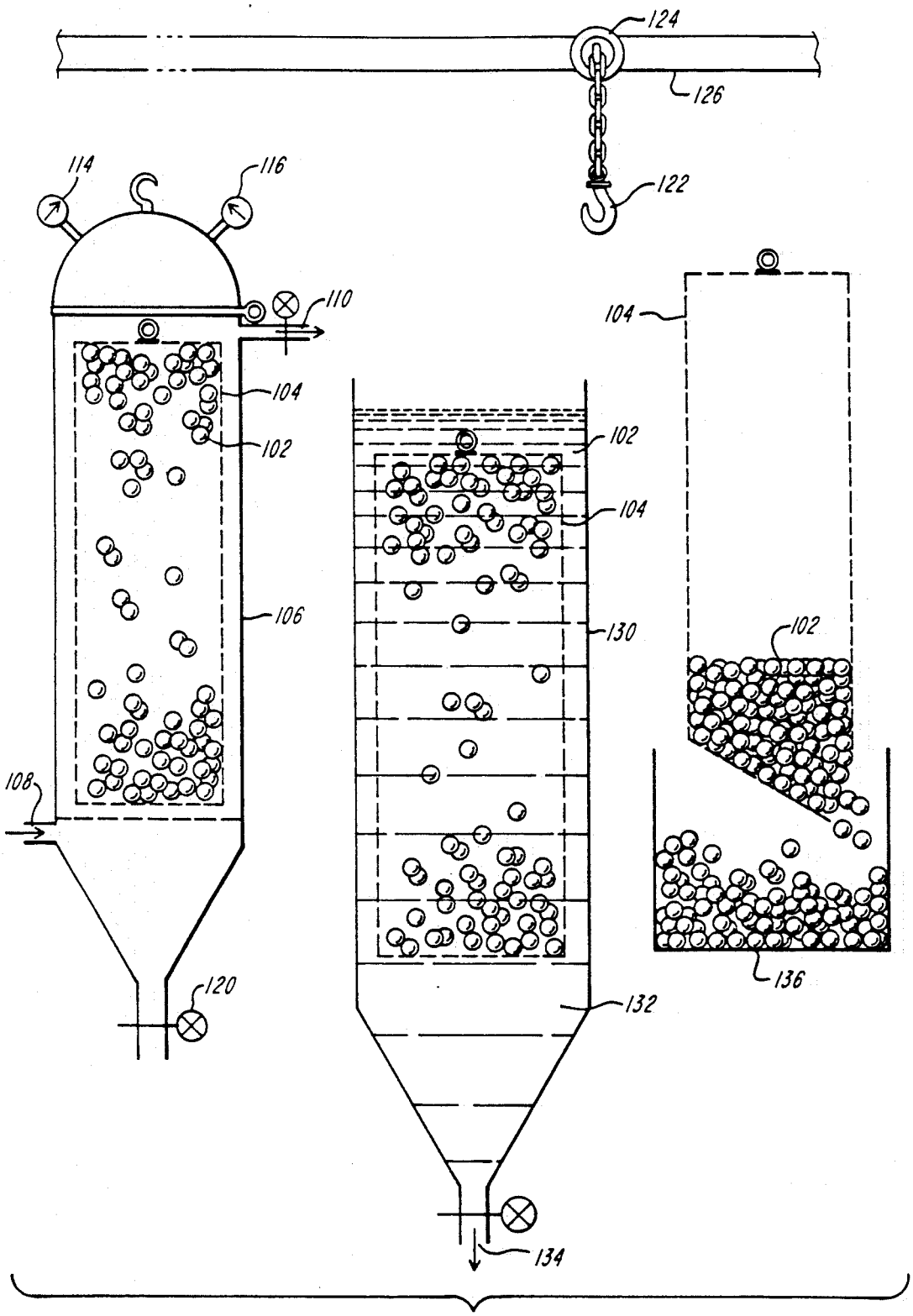
FIG. 2 shows a schematic cross-sectional view of an apparatus used in a second embodiment of the method of the invention for exposing stones to pressurized steam and oxidizing agent.

Turning now to FIG. 2, an apparatus is shown having several components, each more specialized in the treatment of the stones. The pumice stones 102 are maintained in an open-walled, cage-like enclosure 104. The cage fits into a pressurizable vessel 106. A valve or inlet port 108 is provided for the introduction of steam. An outlet port 110 is provided for removing steam. A thermometer 114 and a pressure gauge 116 are provided for monitoring temperature and pressure. A valve 120 is provided for the release of condensed steam.

According to this embodiment, the high pressure steam is provided into the pressure vessel 106 to impregnate the porous pumice stones with high pressure steam. After this step, the steam is released through outlet port 110 until the pressure reaches atmospheric. Then the vessel is opened and the cage 104 is removed from the vessel by means of hook 122 and crane 124 shown schematically on overhead track 126. The cage 104 is lifted out of the pressurizable vessel 106 and placed into a soaking vessel 130, which need not be pressurized. This soaking vessel is filled with liquid oxidizing solution 132. A drain 134 is provided for the release of oxidizing solution once it has been sufficiently contaminated.

An advantage of this apparatus is that the cage 104 filled with the pumice stone 102 simply loaded into the oxidizing solution and is then drawn out and carried to a collection box 136 after excess oxidizing solution stops dripping from the treated stones 102. It is not necessary to drain the oxidizing solution 132 from the soaking vessel 130 after each time a cage 104 of pumice stones are treated with oxidizing agent. This minimizes the handling. Further, the more expensive pressurizable vessel 106 is not tied up during the step of introducing the oxidizing agent. Thus, the embodiment shown in FIG. 2 can treat more stones in the same period of time, as compared to the embodiment shown in FIG. 1.

It has been determined that pumice stones which have been soaked for the same period of time according to the method of the invention maintain their capacity to dispense oxidizing agent for a significantly longer period of time than do those which have not been so treated. The improvement is on the order of 40% to 60%. Thus, the oxidizing stones can be used for larger quantities of fabric and need not be recharged. This provides a saving of labor, time and of course the expense of additional raw material for pumice stones.

The foregoing description is intended to be an illustrative and not to be limiting in any sense. Extensions and variations of the basic invention will be understood by one of ordinary skill in the art to be within the scope of the foregoing disclosure and the following claims. For instance, the fabric to be distressed may be wet, damp or dry. It may be made up into clothing or in bulk form.

Having thus described the invention, what is claimed is:

1. A method for impregnating pumice stones for use in distressing fabric or garments comprising the steps of:

a. providing a pressurizable vessel;

b. placing said stones inside said pressurizable vessel;

c. injecting steam into said pressurizable vessel at a pressure above atmospheric pressure for a preselected time such that said stones are substantially impregnated with steam;

d. reducing the pressure applied to said stones to atmospheric;

e. draining a substantial portion of said steam from said stones;

f. applying an oxidizing agent to said stones to substantially completely contact said stones with said oxidizing agent; and g. removing excess oxidizing agent from said stones.

2. The method of claim 1, wherein said step of applying an oxidizing agent to said stones is conducted in said pressurizable vessel.

3. The method of claim 1, wherein said step of applying an oxidizing agent to said stones is conducted in a soaking vessel different from said pressurizable vessel.

4. The method of claim 1 wherein said oxidizing agent is selected from the group of potassium permanganate, sodium hypochlorite, sodium chlorite, sodium persulfate, sodium percarbonate and hydrogen peroxide.

5. The method of claim 1 wherein said steam is applied to said stones at approximately 20 pounds per square inch.

6. The method of claim 5 wherein said predetermined time is approximately 5 minutes.

7. The method of claim 1 further comprising the steps of:

a. providing a vessel having an open wall construction;

b. before the step of providing a pressurizable vessel, placing said stones in said open wall vessel; and c. placing said open walled vessel containing said stones in said pressurizable vessel.

* * * * *